US007441347B2

(12) United States Patent
LeVert et al.

(10) Patent No.: US 7,441,347 B2
(45) Date of Patent: Oct. 28, 2008

(54) SHOCK RESISTANT SHOE

(76) Inventors: Francis E. LeVert, 1909 Matthew La., Knoxville, TN (US) 37923; David Krafsur, 4330 Crane Ct., Loveland, CO (US) 80537

( * ) Notice: Subject to any disclaimer, the term of this patent is extended or adjusted under 35 U.S.C. 154(b) by 269 days.

(21) Appl. No.: 11/174,021

(22) Filed: Jul. 1, 2005

(65) Prior Publication Data

US 2005/0241184 A1 Nov. 3, 2005

Related U.S. Application Data

(63) Continuation-in-part of application No. 10/335,797, filed on Jan. 2, 2003, now abandoned.

(51) Int. Cl.
*A43B 13/28* (2006.01)

(52) U.S. Cl. ..... 36/27

(58) Field of Classification Search ..... 36/27, 36/28, 7, 8

See application file for complete search history.

(56) References Cited

U.S. PATENT DOCUMENTS 507,490 A 10/1893 Gambino
733,167 A 7/1903 Denton
1,127,456 A * 2/1915 Kurz ..... 36/38
1,139,417 A * 5/1915 Hering ..... 36/38
1,380,879 A * 6/1921 Young ..... 36/3 R
2,157,912 A 5/1939 Nabokin
2,299,009 A 10/1942 Denk
2,441,039 A 5/1948 Smith et al.
5,367,792 A 11/1994 Daniel et al.
5,651,196 A 7/1997 Hsieh
5,697,171 A 12/1997 Phillips
6,006,449 A 12/1999 Orlowski et al.
D434,548 S * 12/2000 Gallegos ..... D2/905
6,393,731 B1 5/2002 Moua et al.
6,665,957 B2 12/2003 Levert et al.
2003/0217483 A1* 11/2003 Abraham ..... 36/28

* cited by examiner

*Primary Examiner*—Ted Kavanaugh

(57) ABSTRACT

A sole assembly for a shock resistant shoe includes a sole having a heel region and a ball region. A first cone spring, disposed within the sole, includes a large diameter terminal end and an opposing small diameter terminal end. The large diameter terminal end is disposed above the small diameter terminal end.

7 Claims, 3 Drawing Sheets

SHOCK RESISTANT SHOE

CROSS-REFERENCE TO RELATED APPLICATIONS

Pursuant to 35 USC Section 119, this application claims the benefit of priority from Provisional Application Ser. No. 60/345,667 with a filing date of Jan. 4, 2002, and is a continuation-in-part of Non-Provisional Application Ser. No. 10/335,797 with a filing date of Jan. 2, 2003.

STATEMENT REGARDING FEDERALLY SPONSORED RESEARCH OR DEVELOPMENT

Not Applicable

BACKGROUND OF THE INVENTION

1. Field of Invention

In most running, walking, and jumping activities, the return force resulting from foot strikes causes great shock to the body. Repeated foot strikes place great stress on joints and bones, and can cause injuries to the lower back and the rotating joints of the legs. To minimize injury to the body resulting from repeated foot strikes, and also to improve athletic performance, shoe engineers have designed various spring-cushioned shoes. The springs in spring-cushioned shoes are designed to reduce shock to the body during a foot strike, and also to recover and return impact energy to the user.

One type of spring-cushioned shoe is described in U.S. Pat. No. 6,282,814 to Krafsur et al., which is incorporated herein by reference.

BRIEF SUMMARY OF THE INVENTION

In most running, walking, and jumping events, the foot follows a prescribed set of motions. The heel impacts the ground first, the weight then shifts forward onto the ball of the foot in a rolling manner, and the toe region provides the last contact with the ground. It is desirable to absorb as much of the impact energy from the both the heel and ball areas of the foot during a foot strike, while still providing a stable landing and not slowing down the user.

In one aspect, the present invention features a spring cushioned shoe with at least one cone spring disposed within the sole of the shoe. The cone spring includes a large diameter end and an opposing small diameter end. The cone spring is positioned in an "inverse orientation," wherein the large diameter end is disposed above the small diameter end. The small diameter end faces downward, toward the outer sole of the shoe, so that the spring returns energy to the user in a manner consistent with the rolling motion of the foot during a foot strike.

BRIEF DESCRIPTION OF THE DRAWING

The above-mentioned features of the invention will become more clearly understood from the following detailed description of the invention read together with the drawings in which.

DETAILED DESCRIPTION OF THE INVENTION

An embodiment of the present invention will be described below with reference to the accompanying figure.

Figure 1:
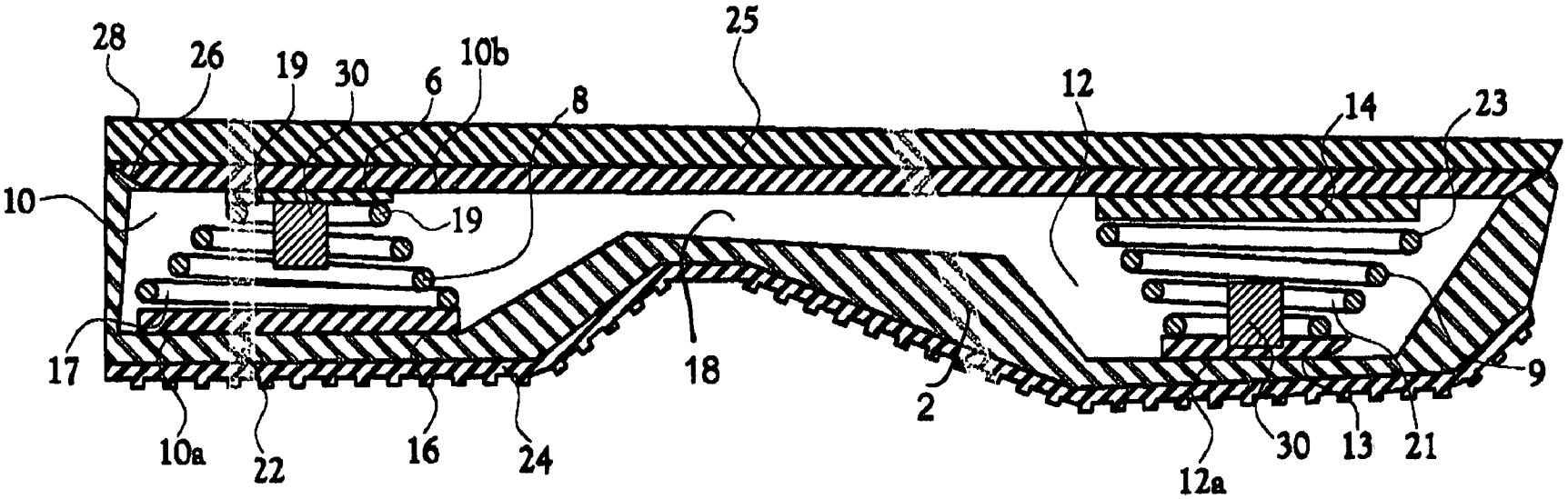
FIG. 1 is a cross sectional side view of a shoe midsole assembly having cone springs disposed within the heel and ball areas of the assembly.

Referring to FIG. 1, a midsole 2 includes first and second surfaces 22 and 26, respectively, positioned such that first surface 22 can be adhesively attached to an ordinary outer sole 24. The second surface 26 is designed to attach adhesively to inner sole 25. Inner sole 25 provides contact area 28 for an upper shoe portion (not shown) to be attached to midsole 2.

Midsole 2 contains vacuities 10 and 12 positioned in the heel and ball areas of midsole 2, respectively. Vacuities 10 and 12 communicate with each other by way of fluid flow pathway 18, which allows the free flow of fluid there between, as described in the co-pending U.S. patent application assigned Ser. No. 09/982,520, which is incorporated herein by reference. Alternatively, the vacuities 10 and 12 and the pathway 18 may be filled, either partially or completely, with a low density, polymeric foam to encapsulate the spring mechanisms described more fully hereinafter.

A first cone spring 8 is positioned in the heel vacuity 10 of midsole 2. Cone spring 8 has a large diameter terminal end 17, and a small diameter terminal end 19; the large diameter terminal end 17 faces downward, toward the outer sole 24, and the small diameter terminal end 19 faces upward, towards inner sole 25. Terminal end 17 is in mechanical contact with plate 16, to resist lateral movement relative to the plate 16, as by welding, adhesive, virtual interference, engagement in a slot defined in the plate 16 or physical attachment. The small diameter terminal end 19 is firmly attached to a first surface plate 6, to resist lateral movement relative to the plate 6, as by welding, adhesive, virtual interference, engagement in a slot defined in the plate 6 or physical attachment. A textured face of the plate 16 is held in adhesive contact with a lower surface 10*a* of vacuity 10. Plate 6 is in mechanical contact with the upper surface 10*b* of the vacuity 10. A spring compression limiter 30 is attached to the axial center of plate 6, in a vertical orientation, to prevent the full compression of cone spring 8 during use.

Plates 6 and 16 are constructed of sheet metallic material, but could also be made from various other metal or non-metallic materials. The spring compression limiter 30 is made of a polymeric material.

An embodiment of the present invention will be described below with reference to the accompanying figure.

Referring to FIG. 1, a midsole 2 includes first and second surfaces 22 and 26, respectively, positioned such that first surface 22 can be adhesively attached to an ordinary outer sole 24. The second surface 26 is designed to attach adhesively to inner sole 25. Inner sole 25 provides contact area 28 for an upper shoe portion (not shown) to be attached to midsole 2.

Midsole 2 contains vacuities 10 and 12 positioned in the heel and ball areas of midsole 2, respectively. Vacuities 10 and 12 communicate with each other by way of fluid flow pathway 18, which allows the free flow of fluid there between, as described in the co-pending U.S. patent application assigned Ser. No. 09/982,520, which is incorporated herein by reference. Alternatively, the vacuities 10 and 12 and the pathway 18 may be filled, either partially or completely, with a low density, polymeric foam to encapsulate the spring mechanisms described more fully hereinafter.

A first cone spring 8 is positioned in the heel vacuity 10 of midsole 2. Cone spring 8 has a large diameter terminal end 17, and a small diameter terminal end 19; the large diameter terminal end 17 faces downward, toward the outer sole 24, and the small diameter terminal end 19 faces upward, towards inner sole 25. Terminal end 17 is in mechanical contact with plate 16, to resist lateral movement relative to the plate 16, as by welding, adhesive, virtual interference, engagement in a slot defined in the plate 16 or physical attachment. The small diameter terminal end 19 is firmly attached to a first surface plate 6, to resist lateral movement relative to the plate 6, as by welding, adhesive, virtual interference, engagement in a slot defined in the plate 6 or physical attachment. A textured face of the plate 16 is held in adhesive contact with a lower surface 10*a* of vacuity 10. Plate 6 is in mechanical contact with the upper surface 10*b* of the vacuity 10. A spring compression limiter 30 is attached to the axial center of plate 6, in a vertical orientation, to prevent the full compression of cone spring 8 during use.

Plates 6 and 16 are constructed of sheet metallic material, but could also be made from various other metal or non-metallic materials. The spring compression limiter 30 is made of a polymeric material.

A second cone spring 9 is positioned in ball vacuity 12 of midsole 2. Like cone spring 8, cone spring 9 has a large diameter terminal end 23 and a small diameter terminal end 21. Unlike spring 8, spring 9 is positioned within the ball vacuity such that the large diameter end 23 faces upward, toward inner sole 25, and the smaller diameter end 21 faces downward, toward outer sole 24.

The second cone spring 9 is positioned between plates 13 and 14 in the ball vacuity 12. The first face of plate 13 is adhesively attached to surface 12*a* of vacuity 12, and the second face of plate 13 is attached to the small diameter end 21 of spring 9 by an adhesive. Alternatively, the small diameter end of cone spring 9 may be attached to plate 13 with a mechanical fastener. Plate 14 is attached, at one face, to the large diameter end 23 of coil spring 9, and is attached adhesively at its opposite face to surface 26. The ball vacuity also includes a compression limiter 30, as described above in connection with heel vacuity 10.

Positioning the ball area cone spring 9 in this "inverse" orientation takes into account the rolling motion of the ball portion of the foot during a foot strike. This inverse orientation allows the outer sole, as it rolls over the ball of the foot, to pivot over a smaller surface of spring 9. As a result, the spring 9 returns energy to the user over a greater portion of the ball strike, and therefore returns a greater percentage of the impact energy to the user.

The cone springs 8 and 9 are both multi-turn coil springs, having a large diameter terminal end and a small diameter terminal end, as described above and as shown in FIG. 1. The springs 8 and 9 taper evenly from the large diameter ends to the small diameter ends. The springs can be made from metal, or various non-metallic polymeric materials.

Other embodiments are also possible. For example, both the heel and ball area cone springs could be disposed in the "inverse orientation," with the small diameter end facing downward, as shown above for cone spring 9.

The cone springs 8 and 9 need not have a conical shape. So long as the springs have a small diameter end and an opposing large diameter end, the spring need not taper evenly from the large end to the small end. For example, the diameter might remain constant for a portion near the large diameter end, and then taper to the small diameter end. Alternatively, the spring may bulge in the middle section.

Figure 2A:
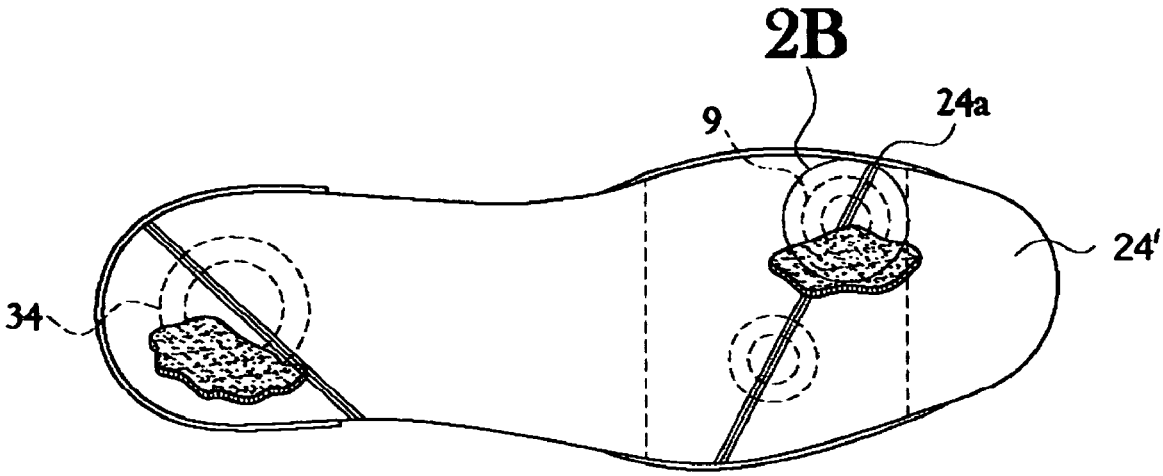
FIG. 2A is a plan view of the outsole assembly of one embodiment of the present invention.
Figure 2B:
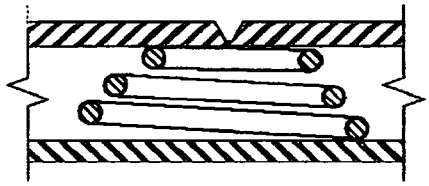
FIG. 2B is a cross sectional side view of the section of FIG. 2A identified as 2B.

As depicted in FIG. 2A, a wave spring 34 may be placed in the heel vacuity 10 instead of a cone spring. Such an embodiment includes a wave spring in the heel area, as described, e.g., in U.S. Pat. No. 6,282,814, and at least one inversely oriented cone spring 9 in the ball area, with the outsole material mechanically formed with flex line 24*a* to enhance the flexing of the outsole 24' about a vertical plane that includes the axial center line of at least one inversely installed cone spring 9.

Multiple springs may be included in each vacuity. For example, the heel vacuity 10 may include multiple wave springs, multiple cone springs, or a combination of wave springs and cone springs. Similarly, ball vacuity 12 may include multiple inversely oriented cone springs, or a combination of wave springs and inversely oriented cone springs. Alternatively, the multiple. heel and ball springs may be disposed within multiple heel and ball vacuities.

The springs may be disposed within the heel and ball vacuities using, e.g., countersunk volumes and shim ends, as described in U.S. Pat. No. 6,282,814.

Figure 3:
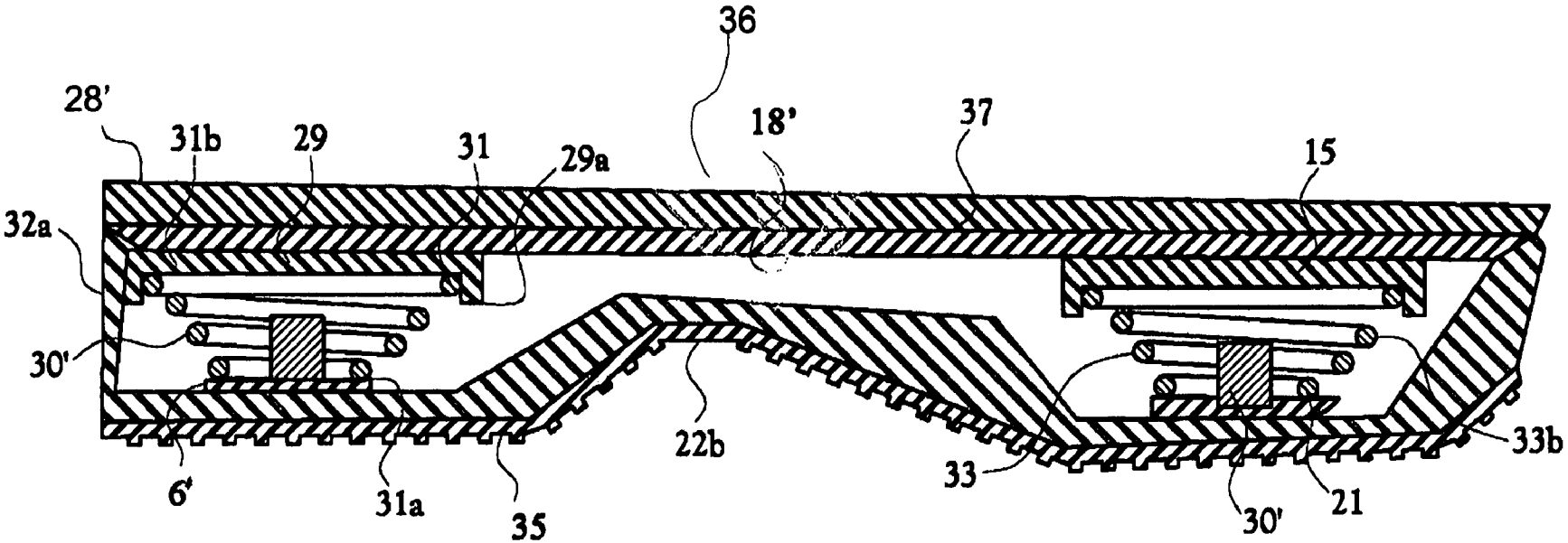
FIG. 3 is a cross sectional side view of an alternative embodiment of a shoe midsole assembly having cone springs disposed within the heel and ball areas of the assembly.

In the alternative embodiment of the midsole of the present invention depicted in FIG. 3, the interior of the midsole is substantially filled with a fluid throughout its volume, which is designed with analytic transition between the heel and ball regions of the midsole 32*a*. The midsole assembly 36 of this alternative embodiment comprises a midsole 32*a*, an outsole 35, plates 15 and 29, compression limiters 30' and inner sole 37. The bottom surface of the inner sole 37 is adhesively attached to the plates 15 and 29. The upper surface of the inner sole 37 is attached to an upper portion (not shown) of the shoe. The curvature and materials of construction of the arch area 22*b* of the midsole 32*a* limits the flexing of the midsole 32*a* in the zone of a finished shoe that includes the subject midsole. The cone spring 31 in the heel region of the midsole 32*a* is mounted in an inverse position as compared to the heel cone spring 8 of FIG. 1. The small diameter end 31*a* is in non-slipping contact with plate 6'. The large diameter end 31*b* of the spring 31 is rigidly mounted in the first surface 29*a* of plate 29. The first surface 29*a* of plate 29 is structurally designed to receive a substantial portion of the last turn of the large diameter end of the cone spring 31. The cone spring 33 in the ball region of the midsole as described in relation to the embodiment of FIG. 1 with the exception of plate 15 which is structurally designed to receive a substantial portion of the last turn of the large diameter end 33*b* of cone spring 33 with fixed certainty as in the case of plate 29.

The materials of the lateral sides of the midsole 32*a* proximate to cone springs 31 and 33 are made of compliant materials with effective regional spring constants less than the spring constants of the cone springs located in proximity thereto. The compliant material of the midsole 32*a* is made of an opaque thermoplastic elastomeric material. It may be made using a transparent TPU or TPE where the lateral sides of the midsole 32*a*, plate 6', compression limiters 30', plate 13 and outsole 35 of the midsole assembly may be integrally assembled as indicated generally in FIG. 3.

From the foregoing description, it will be recognized by those skilled in the art that an improved sole assembly has been provided.

While the present invention has been illustrated by description of several embodiments and while the illustrative embodiment has been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. A sole assembly for an article of footwear comprising:

a sole having an outer sole, a heel region and a ball region: only a single cone spring having an axial center line and disposed within a region selected from said bull region, said cone spring including a large diameter terminal end, and an opposing small diameter terminal end, said large diameter terminal end being disposed above said small diameter terminal end, and, a compression limiter mounted in a manner so as to prevent the total compression of the cone spring when pivoting over the small diameter terminal end of said cone spring during the rolling motion of a foot strike.

2. A sole assembly in accordance with claim 1 and further comprising a wave spring located in said heel region of said sole.

3. A sole assembly in accordance with claim 1 wherein said cone spring is at least partially encapsulated in low density foam.

4. A sole assembly in accordance with claim 1 and further comprising a second cone spring disposed within said heel region, said second cone spring including a large diameter terminal end and an opposing small diameter terminal end.

5. A sole assembly in accordance with claim 4 wherein said sole defines a second vacuity and said second cone spring is disposed within the second vacuity.

6. A sole assembly for an article of footwear comprising:

a sole having an outer sole, a heel region and a ball region; a first cone spring disposed within said ball region of the sole, said cone spring including a large diameter terminal end and an opposing small diameter terminal end, said large diameter end being disposed above said small diameter terminal end;

means of limiting full compression of said spring disposed within the ball region to allow pivoting across the small diameter terminal end of the cone spring;

a second cone spring disposed within said heel region having a large diameter end and an opposing small diameter terminal end with the small diameter terminal end adjacent to the outer sole.

7. a sole assembly in accordance with claim 1 and further comprising a second cone spring having an axial center line and disposed with a region selected from said ball region and said heel region, said second cone spring including a large diameter terminal and an opposing small diameter terminal end, said large diameter terminal end being disposed above said small diameter terminal end to provide a second smaller pivot adjacent to said outer sole, said outer sole including a flex line within a vertical plane that includes said axial center line of said first cone spring and said second cone spring.

* * * * *